US010181669B2

(12) United States Patent
Tsai et al.

(10) Patent No.: US 10,181,669 B2
(45) Date of Patent: Jan. 15, 2019

(54) LARGE-SLIPPAGE CONNECTOR

(71) Applicant: DONGGUAN C.C.P.CONTACT PROBES CO., LTD., Dongguan (CN)

(72) Inventors: Tsung-Ming Tsai, Dongguan (CN); Yu-Shou Lin, Dongguan (CN); Shen-Yi Hsieh, Dongguan (CN)

(73) Assignee: DONGGUAN C.C.P. CONTACT PROBES CO., LTD., Dongguan, Guangdong (CN)

( * ) Notice: Subject to any disclaimer, the term of this patent is extended or adjusted under 35 U.S.C. 154(b) by 0 days.

(21) Appl. No.: 15/803,867

(22) Filed: Nov. 6, 2017

(65) Prior Publication Data

US 2018/0183167 A1 Jun. 28, 2018

(30) Foreign Application Priority Data

Dec. 27, 2016 (CN) ..... 2016 1 1227830

(51) Int. Cl.
*H01R 13/24* (2006.01)

(52) U.S. Cl.
CPC ..... *H01R 13/2421* (2013.01); *H01R 13/2478* (2013.01)

(58) Field of Classification Search
CPC ..... H01R 13/2421
USPC ..... 439/700, 824, 17; 324/755.05; 299/277
See application file for complete search history.

(56) References Cited

U.S. PATENT DOCUMENTS 911,943 A * 2/1909 Culver ..... F02P 7/0632 200/277
1,255,785 A * 2/1918 Savage ..... A47J 43/282 425/283
1,651,314 A * 11/1927 Beasley, Jr. ..... H01H 19/58 200/277
2,773,964 A * 12/1956 Majkrzak ..... H01H 1/06 200/275
3,278,715 A * 10/1966 Arbonies ..... H01R 39/643 200/277
3,378,810 A * 4/1968 Dorrell ..... H01R 13/2471 200/242
4,050,762 A * 9/1977 Hines ..... G01R 1/06722 200/46
5,159,265 A * 10/1992 Alfonso ..... G01R 1/06722 324/72.5
5,308,941 A * 5/1994 Hoh ..... H01H 1/16 200/277
5,645,433 A * 7/1997 Johnson ..... G01R 1/07314 439/66

(Continued)

*Primary Examiner* — Neil Abrams
(74) *Attorney, Agent, or Firm* — Leong C. Lei

(57) ABSTRACT

A pogo pin connector includes: a piston cylinder, a cylindrical piston with its bottom latched into the piston cylinder and capable of moving along the piston. cylinder axially; a needle head partially latched into the piston and capable of rotating freely in the piston, a spring installed between the needle head and the bottom of the piston cylinder for pushing the needle head to the outside, such that the top of the needle may protrude from the top of the needle head under the elastic effect of the spring. The needle head is latched to the top of the piston under the elastic effect of the spring and the top of the needle head protrudes from the piston to contact with a connecting member for an electrical conduction when there is no external pressure.

19 Claims, 2 Drawing Sheets

(56) References Cited

U.S. PATENT DOCUMENTS

| | | | | |
|---|---|---|---|---|
| 5,899,753 | A * | 5/1999 | Wong | H01R 39/643 439/17 |
| 6,758,682 | B1 * | 7/2004 | Kosmala | H01R 13/2421 439/66 |
| 6,905,350 | B1 * | 6/2005 | Wallash | H01R 13/6485 439/181 |
| 7,479,794 | B2 * | 1/2009 | Chartarifsky | G01R 1/07342 324/755.05 |
| 7,749,032 | B1 * | 7/2010 | Yin | H01R 13/2421 439/482 |
| 7,789,719 | B1 * | 9/2010 | Yin | G01R 1/06722 439/700 |
| 8,062,078 | B2 * | 11/2011 | Asai | H01R 13/2421 439/482 |
| 8,337,256 | B1 * | 12/2012 | Lin | 439/700 |
| 8,575,466 | B2 * | 11/2013 | van Ekstrom | G10H 3/183 84/743 |
| 8,734,189 | B2 * | 5/2014 | Kim | H01R 13/2421 439/482 |
| 9,225,095 | B2 * | 12/2015 | Van Ekstrom | H01R 13/2421 |
| 9,431,742 | B2 * | 8/2016 | DiFonzo | H01R 13/17 |
| 9,780,475 | B2 * | 10/2017 | Kim | H01R 13/62 |

* cited by examiner

LARGE-SLIPPAGE CONNECTOR

CROSS-REFERENCE TO RELATED APPLICATIONS

This non-provisional application claims priority under 35 U.S.C. § 119(a) on Patent Application No(s). 201611227830.3 filed in China, P.R.C. on Dec. 27, 2016, the entire contents of which are hereby incorporated by reference.

FIELD OF THE INVENTION

The present invention relates to the technical field of precision connectors, and more particularly a pogo pin connector.

BACKGROUND OF THE INVENTION

1. Description of the Related Art

Pogo pin connector is a precision connector generally applied in electronic products such as mobile phones and extensively applied to semiconductor devices for the purpose of connection.

The conventional needle head being a spherical pogo pin connector only has a compression approximately equal to ⅓ of the diameter of the sphere after assembling, and thus the amount of compression is too small, and the positive force is insufficient. As a result, the impedance is unstable, and the electric power may be lost easily. Since the needle head is spherical, so that a poor contact between the needle head and the needle may occur easily and thus resulting in the too-large impedance in the connection, and affecting the performance of the product.

Therefore, it is a main subject for related manufacturers and designers to overcome the aforementioned drawbacks including the small compression and poor contact of the connector.

2. Summary of the Invention

Therefore, it is a primary objective of the present invention to provide a large-slippage connector with a structural design capable of overcoming overcome the drawbacks of the conventional connector.

Therefore, it is a primary objective of the present invention to provide a pogo pin connector with a structural design capable of overcoming overcome the drawbacks of the conventional connector.

To achieve the aforementioned and other objectives, the present invention provides a pogo pin connector, comprising: a piston cylinder; a cylindrical piston, with a bottom latched into the piston cylinder, and capable of moving along the piston cylinder axially; a needle head, partially latched into the piston, and capable of rotating freely in the piston, a spring, installed between the needle head and the bottom of the piston cylinder, for pushing the needle head to the outside, such that the top of the needle may protrude from the top of the needle head under the elastic effect of the spring.

Preferably, the piston has a first flange formed at the top of the piston for preventing the needle head from falling out from the piston, and the needle head abuts the inner side of the first flange under the elastic effect of the spring.

Preferably, the piston cylinder has a second flange formed at the top of the piston cylinder for preventing the piston from falling out, and the bottom of the piston abuts the inner side of the second flange under the elastic effect of the spring.

Preferably, the needle head is a spherical needle head.

Preferably, the pogo pin connector further comprises a cap latched. into the piston, slidably coupled to the piston, and installed between the needle head and the spring, and the axial sliding distance of the cap along the piston being smaller than. the height of the top of the needle head protruding from the piston while having no external pressure.

Preferably, the contact end of the cap and the needle head is a chamfer.

Preferably, the contact end of the cap and the spring has a groove for placing the spring and guiding the retractable direction of the spring.

Preferably, the piston has a third flange formed at the bottom of the piston for preventing the cap from falling out from the piston.

The pogo pin connector of the present invention comprises a piston. cylinder, a cylindrical piston, with a bottom latched into the piston cylinder, and capable of moving along the piston cylinder axially; a needle head, partially latched into the piston, and capable of rotating freely in the piston, a spring, installed between the needle head and the bottom of the piston cylinder, for pushing the needle head to the outside. The top of the needle head protrudes from the piston under the elastic effect of the spring.

The needle head is latched to the top of the piston under the elastic effect of the spring and the top of the needle head protrudes from the piston to contact with a connecting member for an electrical conduction when there is no external pressure. When the needle head is compressed towards the piston by external forces, the piston and needle head may slide along the piston cylinder axially because the piston is slidably coupled to the piston cylinder and the needle head is latched into the piston. The invention increases the compression of the needle head, guarantees the compression force, and improves the stability of impedance.

DESCRIPTION OF THE PREFERRED EMBODIMENTS

The above and other objects, features and advantages of this disclosure will become apparent from the following detailed description taken with the accompanying drawings.

The present invention provides a pogo pin connector with a structural design capable of overcoming the drawbacks of the conventional connector such as the too-small compression and poor contact of the connector.

Figure 1:
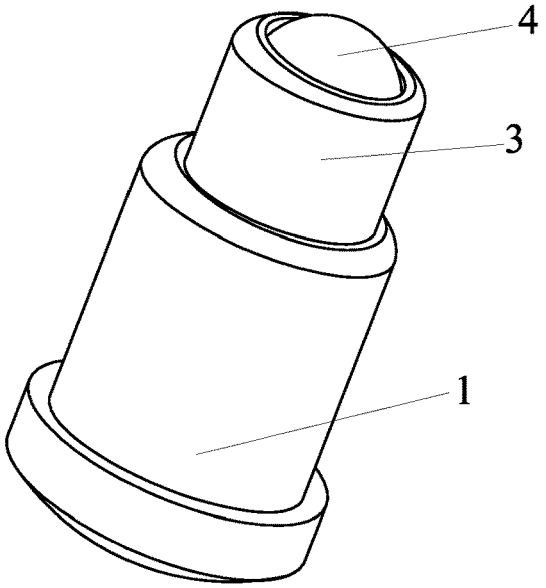
FIG. 1 is a schematic view of a pogo pin connector in accordance with a preferred embodiment of the present invention.
Figure 2:
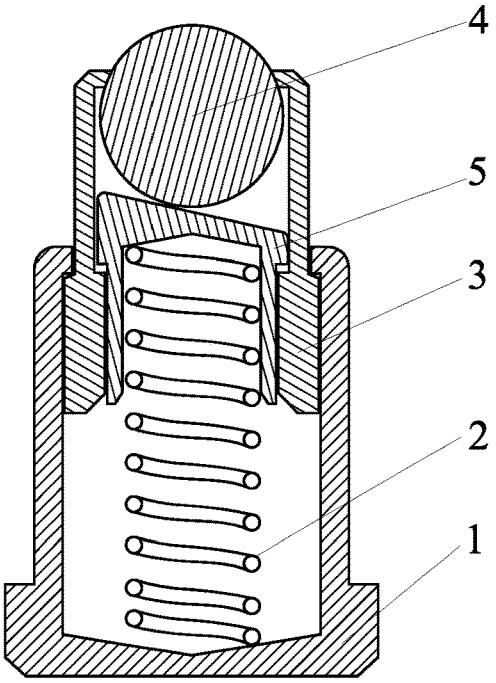
FIG. 2 is a cross-sectional view of a pogo pin connector in. accordance with a preferred embodiment of the present invention.

With reference to FIGS. 1 and 2 for the schematic view and a cross-sectional view of a pogo pin connector in accordance with a preferred embodiment of the present invention respectively, the pogo pin connector comprises a piston cylinder 1, a cylindrical piston 3 and a spherical needle head 4, wherein the bottom of the piston 3 is latched into the piston cylinder 1, and the piston 3 is slidably coupled to the piston cylinder 1. in other words, the piston 3 can move axially along the piston cylinder 1. The needle head 4 is installed in the piston 3 and capable of rotating freely in the piston 3. and a spring 1 is installed between the needle head 4 and the bottom of the piston cylinder 1 and provided for pushing the needle head 4 to the outside. Under the elastic effect of the spring 2, the top of needle head 4 protrudes from the piston 3, and the remaining portion of the needle head 4 is latched into the piston 3.

In the pogo pin connector of the present invention, the needle head 4 is latched to the top of the piston 3, and the top of the needle head 4 protrudes from the piston 3 to contact with a connecting member to achieve the effect of electrical conduction under the elastic effect of the spring and when there is no external pressure. When the needle head 4 is compressed towards the piston 3 by external forces, the piston 3 together with the needle head 4 slide axially along the piston cylinder 1, since the piston 3 is slidably coupled to the piston cylinder 1 and the needle head 4 is latched. into the piston 3. Therefore, the invention achieves the effects of increasing the compression of the needle head 4, guaranteeing the compression force, and improving the stability of impedance.

Figure 3:
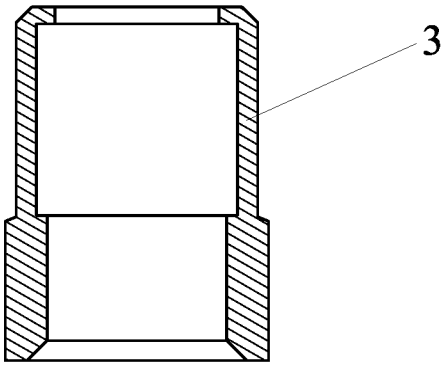
FIG. 3 is a schematic view of a piston in accordance with a preferred embodiment of the present invention.

With reference to FIG. 3 for a schematic view of a piston 3 in accordance with a preferred embodiment of the present invention, the piston 3 of the pogo pin connector of the invention has upper and lower ends communicated to the outside. To prevent the needle head 4 from falling out from the piston 3, the top of the piston 3 may have a first flange, so that the needle head 4 abuts the inner side of the first flange to achieve the effects of protruding the top of the spherical needle head 4 from the piston 3 under the elastic effect of the spring 2 and when there is no external pressure.

Specifically, the first flange may be ring-shaped and disposed around the top of the piston 3, and the internal diameter of the first flange is designed to be smaller than the diameter of the spherical needle head 4 to guarantee that the spherical needle head 4 can move freely in the piston 3. Of course, the first flange may be a plurality of protrusions formed at the top of the piston 3, and it is noteworthy that equivalent arrangements fall within the scope of the present invention.

Based on the preferred embodiments above, the bottom of the piston 3 is latched into the piston cylinder 1. In an embodiment, the top of the piston cylinder 1 has a second flange for preventing the piston 3 from falling out. Under the elastic effect of the spring 2, the bottom of the piston 3 abuts the inner side of the second flange when there is no external pressure.

In the pogo pin connector in accordance with a preferred embodiment of the present invention, the needle head 4 is a spherical needle head 4, and the spherical needle head 4 can rotate freely in the piston 3 and will not get stuck easily, so that the communication is reliable. Of course, the needle head 4 may be in a cylindrical shape, an elliptical shape, or any other shape that can. be rollably or slidably contacted with the piston 3, and these different shaped needle head 4 also fall within the scope of the present invention.

Figure 4:
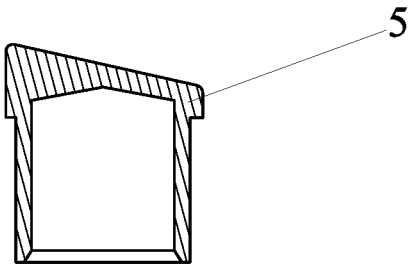
FIG. 4 is a schematic view of a cap in accordance with a preferred embodiment of the present invention.

With reference to FIG. 4 for a schematic view of a cap in accordance with a preferred embodiment of the present invention, the pogo pin connector of the present invention further comprises a cap 5 latched into the piston 3 and installed between the needle head 4 and the spring 2. In other words, the needle head 4 is latched. into the piston 3 through the cap 5.

Preferably, the cap 5 is slidably coupled to the piston 3, and the axial sliding distance of the cap 5 along the piston 3 is preferably smaller than the height of the top of the needle head protruding from the piston 3 when there is no external pressure. Therefore, when the spherical needle head 4 is compressed towards the piston 3 by external forces, the cap 5 and the needle head 4 are moved synchronously. When the cap 5 abuts the piston 3, the piston 3 and the needle head 4 are moved synchronously along the piston cylinder 1 through the cap 5, so as to increase the compression of the needle head 4 and guarantee that the top of the needle head 4 protrudes out from the piston 3 to communicate with the outside.

Based on the preferred embodiments above, the contact end of the cap 5 and the needle head 4 may be a chamfer, so that when the needle head 4 is used to achieve the electrical conduction, the needle head 4 obliquely compresses the cap 5, so that a side of the cap 5 abuts an inner wall of the piston 3, and an outer wall on a side of the piston 3 abuts an inner wall of the piston cylinder 1 to keep the needle head 4, the cap 5, the piston 3, and the piston cylinder 1 in good contact and guarantee a small contact resistance as well as a good conduction performance. Of course, the contact end of the cap 5 and the needle head 4 may be a curved surface, a polygonal surface, or a double slop, etc which facilitates the contact between the cap 5 and the piston 3. All of the aforementioned arrangements fall within the scope of the present invention.

Based on the preferred embodiments above, the spring 2 is installed between the bottom of the piston cylinder 1 and the needle head 4 to facilitate placing the spring 2, and a groove is formed at the contact end of the cap 5 and the spring 2 for placing the spring 2, and the groove is also provided for guiding the spring 2 when the spring 2 is contracted, so as to guarantee the spring 2 can be contracted in an erected position. Of course, there may be no groove, and such arrangement also falls within the scope of the present invention.

Based on the preferred embodiments above, the cap 5 is latched into the piston 3. Specifically, the bottom of the piston 3 may have a third flange preferably ring shaped and disposed around the bottom of the piston 3, wherein the internal diameter of the third flange is preferably smaller than the external diameter of the cap 5 to prevent the cap 5 from falling out from the bottom of the piston 3.

It is noteworthy that the upper and lower parts, or the top and bottom as described in this specification refer to relative positions in the drawings but not indicate particular positions.

What is claimed is:

1. A pogo pin connector, comprising:

a piston cylinder;

a cylindrical piston, with a bottom latched into the piston cylinder, and capable of moving along the piston cylinder axially;

a needle head, partially latched into the cylindrical piston, and capable of rotating freely in the cylindrical piston, a spring, installed between the needle head and a bottom of the piston cylinder, and provided for pushing the needle head outside, such that a top of the needle head protrude from a top of the cylindrical piston under an elastic effect of the spring, wherein the cylindrical piston has a first flange formed at the top of the cylindrical piston for preventing the needle head from falling out from the cylindrical piston, and the needle head abuts an inner side of the first flange under the elastic effect of the spring.

2. The pogo pin connector of claim 1, wherein the piston cylinder has a second flange formed at a top of the piston cylinder for preventing the cylindrical piston from falling out, and a bottom of the cylindrical piston abuts an inner side of the second flange under the elastic effect of the spring.

3. The pogo pin connector of claim 2, wherein the needle head is a spherical needle head.

4. The pogo pin connector of claim 1, further comprising a cap latched into the cylindrical piston, coupled to the cylindrical piston and able to slide, and installed between the needle head and the spring, and an axial sliding distance of the cap along the piston being smaller than a height of a top of the needle head protruding from the piston while having no external pressure.

5. The pogo pin connector of claim 4, wherein a contact end of the cap and the needle head is a chamfer.

6. The pogo pin connector of claim 5, wherein a contact end of the cap and the spring has a groove for placing the spring and guiding a retractable direction of the spring.

7. The pogo pin connector of claim 6, wherein the cylindrical piston has a third flange formed at the bottom of the cylindrical piston for preventing the cap from falling out from the cylindrical piston.

8. The pogo pin connector of claim 1, further comprising a cap latched into the cylindrical piston, coupled to the cylindrical piston and able to slide, and installed between the needle head and the spring, and an axial sliding distance of the cap along the piston being smaller than a height of a top of the needle head protruding from the piston while having no external pressure.

9. The pogo pin connector of claim 8, wherein a contact end of the cap and the needle head is a chamfer.

10. The pogo pin connector of claim 9, wherein a contact end of the cap and the spring has a groove for placing the spring and guiding a retractable direction of the spring.

11. The pogo pin connector of claim 10, wherein the cylindrical piston has a third flange formed at the bottom of the cylindrical piston for preventing the cap from falling out from the cylindrical piston.

12. The pogo pin connector of claim 2, further comprising a cap latched into the cylindrical piston, coupled to the cylindrical piston and able to slide, and installed between the needle head and the spring, and an axial sliding distance of the cap along the piston being smaller than a height of a top of the needle head protruding from the piston while having no external pressure.

13. The pogo pin connector of claim 12, wherein a contact end of the cap and the needle head is a chamfer.

14. The pogo pin connector of claim 13, wherein a contact end of the cap and the spring has a groove for placing the spring and guiding a retractable direction of the spring.

15. The pogo pin connector of claim 14, wherein the cylindrical piston has a third flange formed at the bottom of the cylindrical piston for preventing the cap from falling out from the cylindrical piston.

16. The pogo pin connector of claim 3, further comprising a cap latched into the cylindrical piston, coupled to the cylindrical piston and able to slide, and installed between the needle head and the spring, and an axial sliding distance of the cap along the piston being smaller than a height of a top of the needle head protruding from the piston while having no external pressure.

17. The large slippage pogo pin connector of claim 16, wherein a contact end of the cap and the needle head is a chamfer.

18. The large slippage pogo pin connector of claim 17, wherein a contact end of the cap and the spring has a groove for placing the spring and guiding a retractable direction of the spring.

19. The large slippage pogo pin connector of claim 18, wherein the cylindrical piston has a third flange formed at the bottom of the cylindrical piston for preventing the cap from a falling out from the cylindrical piston.

* * * * *